US011162290B2

(12) United States Patent
Favero et al.

(10) Patent No.: US 11,162,290 B2
(45) Date of Patent: Nov. 2, 2021

(54) AUTOMATIC BUMP STOP ASSEMBLY

(71) Applicant: Ford Motor Company, Dearborn, MI (US)

(72) Inventors: Kevin Favero, Plymouth, MI (US); Michael Gardynik, Farmington Hills, MI (US)

(73) Assignee: Ford Motor Company, Dearborn, MI (US)

( * ) Notice: Subject to any disclaimer, the term of this patent is extended or adjusted under 35 U.S.C. 154(b) by 37 days.

(21) Appl. No.: 15/787,779

(22) Filed: Oct. 19, 2017

(65) Prior Publication Data

US 2019/0119968 A1 Apr. 25, 2019

(51) Int. Cl.
*E05F 5/02* (2006.01)
*E05B 83/24* (2014.01)

(52) U.S. Cl.
CPC ..... *E05F 5/022* (2013.01); *E05B 83/24* (2013.01); *E05Y 2600/13* (2013.01); *E05Y 2600/14* (2013.01); *E05Y 2600/56* (2013.01); *E05Y 2900/536* (2013.01)

(58) Field of Classification Search
CPC ..... B60R 21/38; E05B 83/16; E05B 83/24; E05B 83/243; E05B 83/247; E05F 5/02; E05F 5/022; Y10T 403/32483; Y10T 16/61; Y10T 16/625; F16B 21/16; F16B 21/165
See application file for complete search history.

(56) References Cited

U.S. PATENT DOCUMENTS 1,482,954 A * 2/1924 Tideman ..... A47L 5/34 16/19
RE28,355 E * 3/1975 Petri ..... F16B 21/165 403/328
5,412,842 A * 5/1995 Riblett ..... E05D 5/12 16/250
5,482,348 A 1/1996 Mass et al.
5,579,558 A * 12/1996 Newman, Jr. ..... B05C 17/0205 15/144.4
5,593,239 A * 1/1997 Sallee ..... E04H 12/182 135/114
6,088,878 A 7/2000 Antonucci et al.
6,092,334 A * 7/2000 Kim ..... E05F 1/006 16/334
6,131,928 A * 10/2000 Tung ..... A45C 13/262 16/113.1
2004/0049882 A1* 3/2004 Schmoll ..... E05C 17/203 16/82
2005/0186023 A1* 8/2005 Lee ..... F16B 7/105 403/109.3

(Continued)

FOREIGN PATENT DOCUMENTS

FR 2987803 3/2015
WO 2002/008554 1/2002

*Primary Examiner* — Emily M Morgan
(74) *Attorney, Agent, or Firm* — Burris Law, PLLC

(57) ABSTRACT

The present disclosure relates to a bump stop assembly that includes a housing, a stopper, and a biasing device. The stopper is moveable relative to the housing and includes a head, a shaft extending from the head, and a plurality of recesses distributed along the shaft. The biasing device is disposed within the housing, and is operable to engage and disengage with at least one recess based on a load exerted on the stopper.

7 Claims, 6 Drawing Sheets

(56) References Cited

U.S. PATENT DOCUMENTS

| | | | | |
|---|---|---|---|---|
| 2005/0249545 | A1* | 11/2005 | Tsai | E04H 15/50 403/109.3 |
| 2007/0226954 | A1* | 10/2007 | Artsiely | E05F 5/04 16/63 |
| 2011/0121523 | A1* | 5/2011 | Erickson | F16B 7/042 279/76 |
| 2011/0236123 | A1* | 9/2011 | Melino, Sr. | F16B 7/1454 403/81 |
| 2012/0319399 | A1* | 12/2012 | Schweizer | B23B 31/1071 285/313 |
| 2015/0167359 | A1* | 6/2015 | Luna | E05F 5/022 292/216 |
| 2016/0215551 | A1* | 7/2016 | Hillgaertner | E05F 3/18 |

* cited by examiner

AUTOMATIC BUMP STOP ASSEMBLY

FIELD

The present disclosure relates to a stop assembly for vehicles.

BACKGROUND

The statements in this section merely provide background information related to the present disclosure and may not constitute prior art.

Generally, a stop assembly is used in vehicles to control the position of a moving component (e.g., a closure) relative to a stationary component upon which the moving component interfaces with. For example, a stop assembly is used to position a hood with a fender such that the hood is substantially flush with the fender. The hood flushness is controlled by adjusting the height of the stop assembly by, for example, rotating a head of the stop assembly. The stop assembly is typically positioned at a front-end module of the vehicle, and operates to align the moveable component (i.e., hood) with the stationary component (i.e., fender).

Interference of the stop assembly to the moveable component can vary based on vehicle build and further due to manufacturing variations, which can lead to insufficient support by the stop assembly. For example, with respect to the hood, if there is insufficient support between the stop assembly and the hood, parts of the hood or the entire hood may move separately from the vehicle causing hood flutter or hood shake. In addition, if the stop assembly is insufficiently interfering with the hood, the stop assembly may not be exerting a load on the hood that causes the hood to lift or pop open when a latch securing the hood to the front-end module is released. To correct the misalignment between the stop assembly and the hood, the height of the stop assembly can be adjusted during manufacturing, which can cause additional steps and delays. The present disclosure addresses these and other issues related to aligning the hood and the fender with the stop assembly.

SUMMARY

In one form, present disclosure is directed to a bump stop assembly that comprises a housing, a stopper moveable relative to the housing, and a biasing device disposed within the housing. The stopper includes a head, a shaft extending from the head, and a plurality of recesses distributed along the shaft. The biasing device is operable to engage and disengage with at least one recess based on a load exerted on the stopper.

In another form, the biasing device is a ball-nose spring plunger.

In yet another form, the plurality of recesses are positioned along two opposite sides of the shaft.

In one form, the biasing device is a spring plunger.

In another form, the stop assembly includes two biasing devices, and the two biasing devices are disposed within the housing on either side of the shaft of the stopper.

In yet another form, the head of the stopper has a resilient elastically deformable portion.

In one form, the stop assembly includes at least two biasing devices, disposed on opposite sides of the shaft and are offset from each other.

In another form, in response to a first load applied to the stopper, the biasing device compresses to disengage with a recess among the plurality of recesses such that the stopper moves relative to the housing. In response to a second load that is less than the first load, the biasing device decompresses to engage with the recess such that a position of the stopper is locked.

In yet another form, based on the load exerted on the stopper, the biasing device disengages with the recess to have the stopper move relative to the housing or engages with the recess to prevent the stopper from moving relative to the housing. During engagement and disengagement, the biasing device is in contact with a surface of the shaft.

In one form, the present disclosure is directed to a bump stop assembly for a vehicle. The assembly comprises a housing, a stopper, and at least two biasing devices. The stopper includes a head and a shaft extending from the head. The shaft extends through the housing and defines a plurality of recesses distributed along the shaft. The at least two biasing devices are disposed in the housing on either side of the shaft to lock and unlock position of the stopper relative to the housing. Each of the biasing devices is operable to engage and disengage with the at least one recess from the plurality of recesses based on a load applied to the stopper.

In another form, the housing defines at least two cavities for housing the at least two biasing devices.

In one form, the at least two biasing devices are disposed offset from each other, and are arranged in the housing such that one of the biasing devices interfaces with the recesses on one side of the shaft and another one of the biasing devices interfaces with the recesses on the other side of the shaft.

In one form, the present disclosure is directed to a vehicular stop assembly that comprises a housing, a stopper, and two spring plungers. The stopper includes a shaft that has multiple recesses distributed thereon. The shaft extends through the housing, and is moveable relative to the housing. The spring plungers are disposed in the housing on opposite sides of the shaft. Each plunger is operable to engage and disengage with at least one recess from the multiple recesses based on a load on the shaft.

In yet another form, the two spring plungers are disposed offset from each other, and are arranged in the housing such that one of the spring plungers interfaces with the recesses on one side of the shaft and the other spring plunger interfaces with the recesses on the other side of the shaft.

In one form, the stopper includes a head that has a resilient elastically deformable member. The head is positioned above the housing, and the shaft extends from the head.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
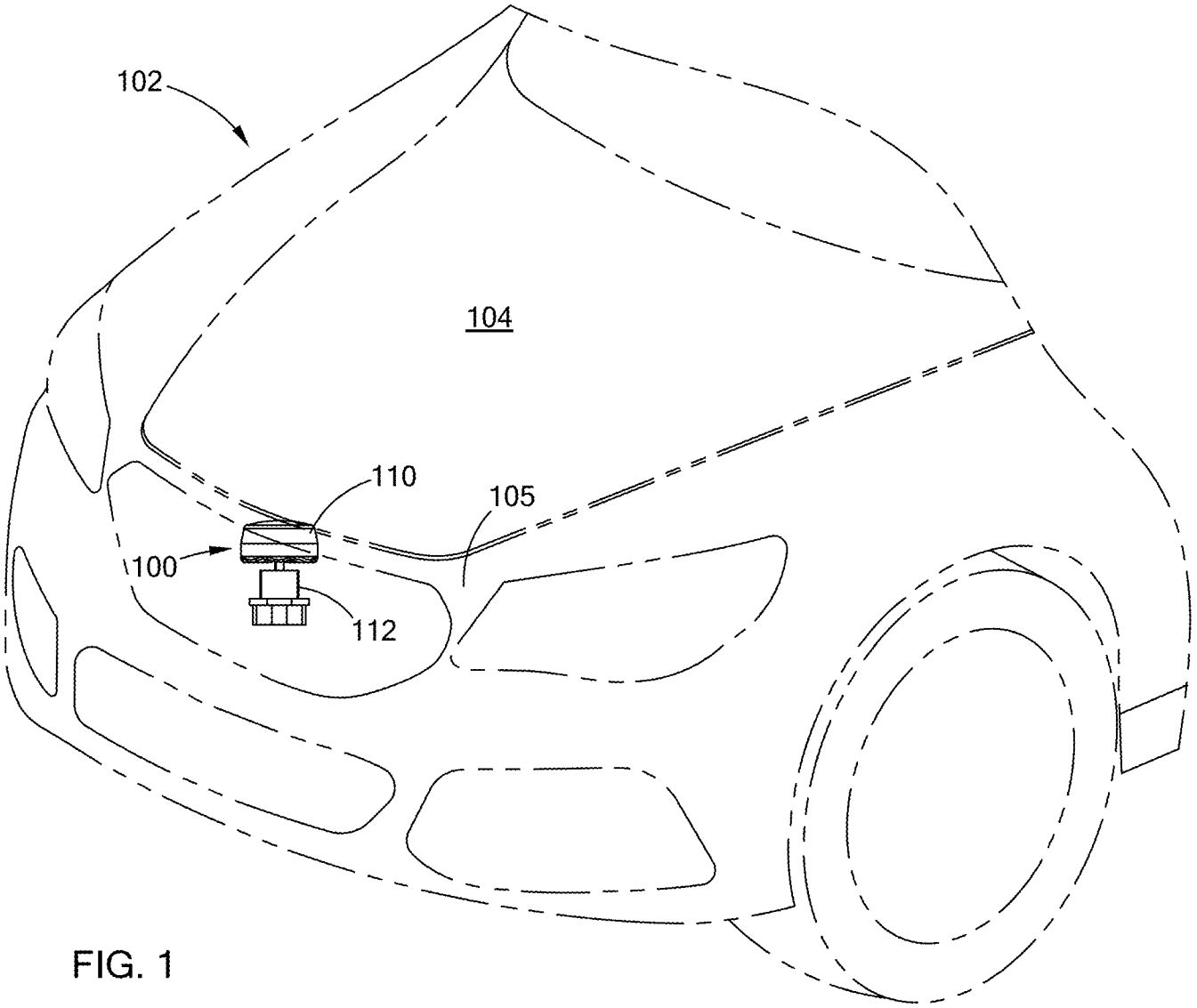
FIG. 1 illustrates a bump stop assembly positioned in a vehicle according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Vehicles generally have multiple moveable components that are operable to rest and align with a portion of the vehicle body (i.e., a stationary component). For example, a door, a hood, a liftgate, and a decklid are all components that can be moved to close and rest on the body. The present disclosure is directed toward a bump stop assembly that utilizes the load of the moveable component to adjust its height i.e., aligning the moveable component with the stationary component and providing support to the moveable component.

More particularly, the bump stop assembly of the present disclosure includes a stopper having multiple recesses defined along a shaft of the stopper, and includes one or more biasing devices that engage with the recesses. In one form, the biasing devices are positioned on opposite sides of the shaft and are positioned offset to operate in a ratchet like manner to engage and disengage with the recesses as a load is applied to the stopper. Based on the direction and amount of load placed on the stopper, the ratchet like movement between the biasing devices and the recesses lowers or elevates the height of the bump stop assembly. The bump stop assembly may also be referred to as a vehicular stop assembly and a stop assembly.

Details of the bump stop assembly is provided hereinafter with reference to the accompanying drawings. In one example application, the stop assembly is described as being positioned in a front-end module of the vehicle for supporting a hood and aligning the hood with a fender. It should be readily understood that the stop assembly can be utilized at other locations of the vehicle, and should not be limited to the front-end module. Furthermore, drawings illustrating the stop assembly in a particular environment illustrate an embellished view of the stop assembly, and thus, are not representative of the true size of the stop assembly relative to the other components in the drawing.

Referring to FIG. 1, a bump stop assembly 100 of the present disclosure is positioned in a vehicle 102 under a hood 104 to provide support and act as a stop to the hood 104 to properly align the hood 104 with a fender 105. The vehicle 102 may include one or more stop assemblies 100 to support the hood 104. For example, a single stop assembly 100 may be positioned centrally to the hood 104, as shown, or multiple stop assemblies 100 may be positioned along a front-end module of the vehicle 102.

Figure 2:
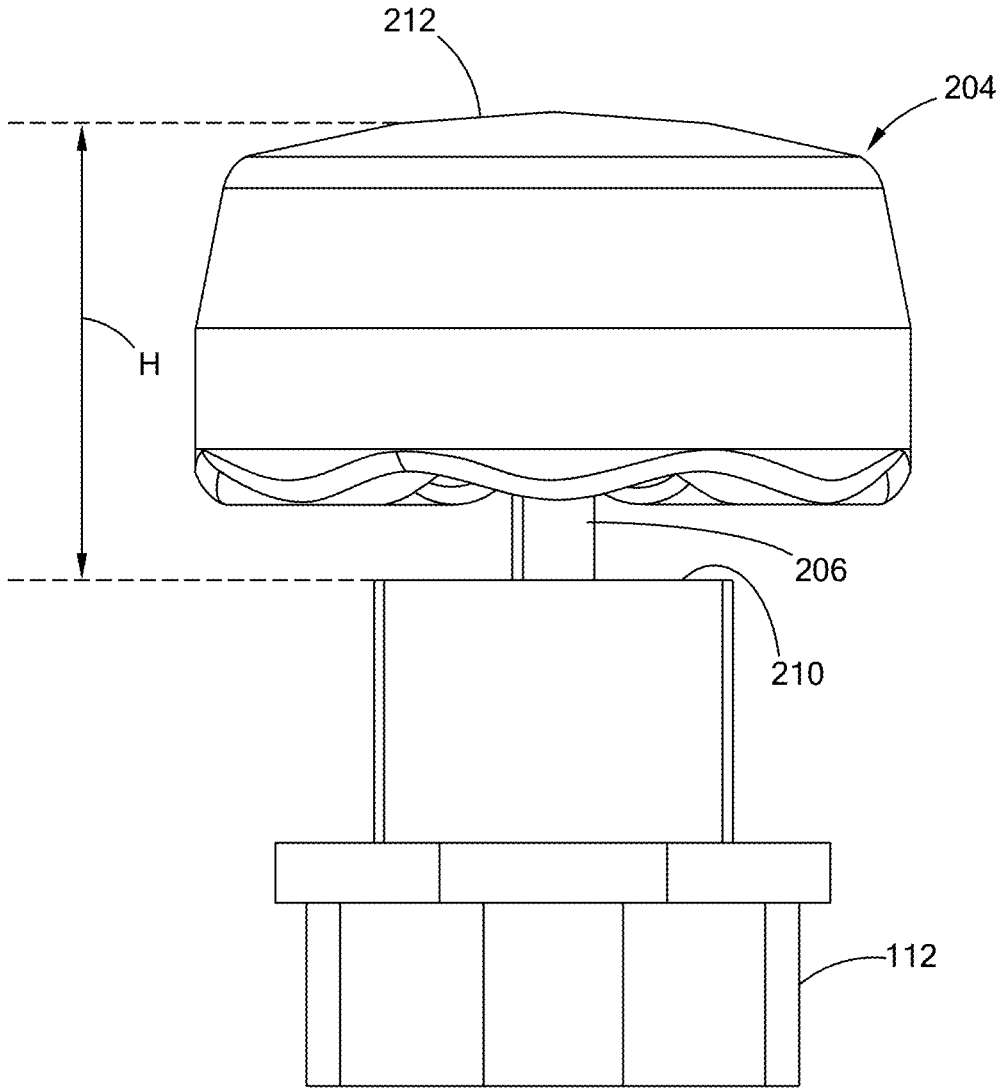
FIG. 2 is a perspective view of the bump stop assembly in FIG. 1.
Figure 3:
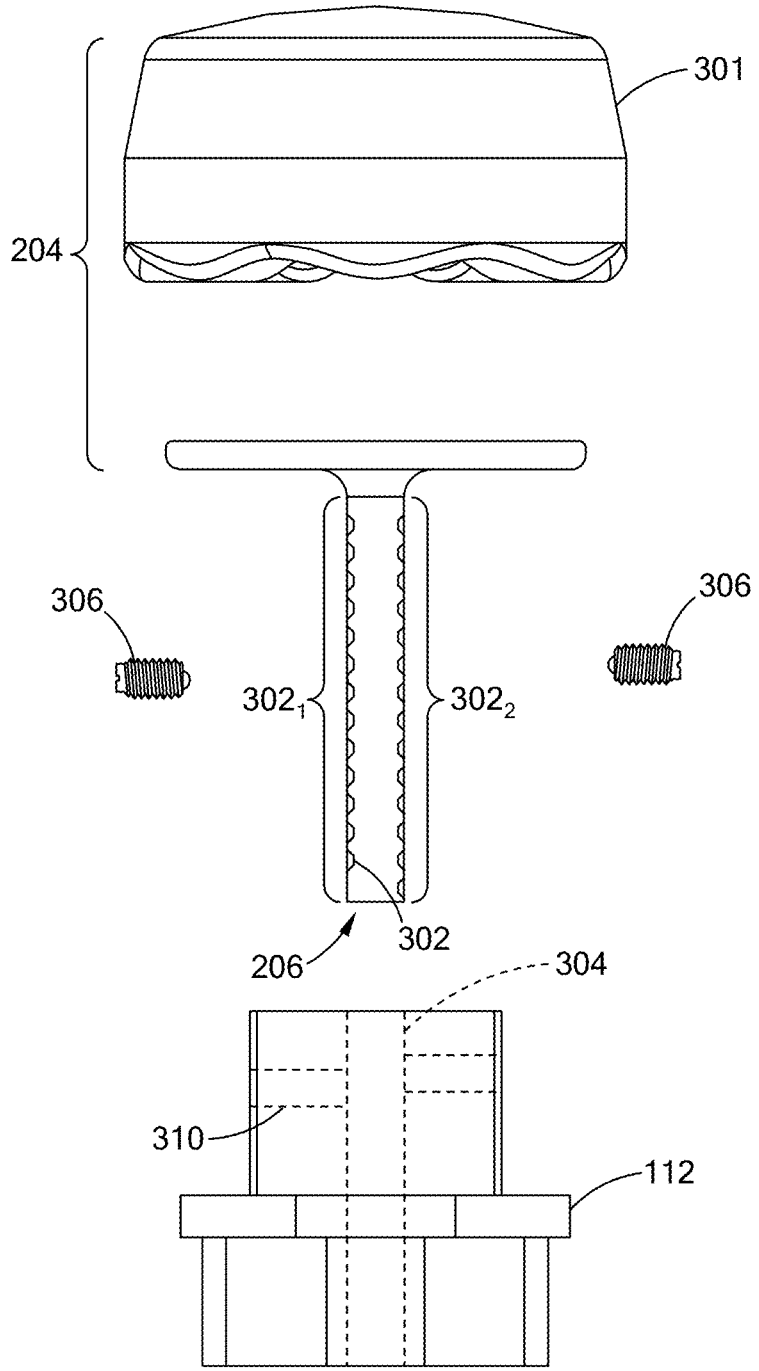
FIG. 3 is an exploded view of the bump stop assembly in FIG. 1.

Referring to FIGS. 2-3, the stop assembly 100 includes a stopper 110, a housing 112, and one or more biasing devices 306 (FIG. 3) disposed in the housing 112. The stopper 110 comprises a head 204 and a shaft 206 extending from the head 204. The head 204 has a resilient elastically deformable portion 301 made of, for example, rubber, plastic, etc. The shaft 206 has a plurality of recesses 302 defined and distributed along a longitudinal axis of the shaft 206. In one form, the recesses 302 are distributed along opposite sides of the shaft 206. That is, a first set of recesses $\mathbf{302}_1$ are provided along a first side of the shaft 206 and a second set of recesses $\mathbf{302}_2$ are provided along a second side of the shaft 206.

The housing 112 can be molded or made in various suitable shapes based on the environment in which the stop assembly vehicle is to be located. For example, in one form, the housing 112 is configured to interface with an ornamental shield and a support bar of the front-end module of the vehicle 102. The housing 112 further defines a passage 304 that extends longitudinally along the housing 112, and is configured to receive the shaft 206 of the stopper 110. In the assembled state, the shaft 206 is moveable along the passage 304, while the head 204 is positioned above the housing 112. In the following, a height of the stop assembly 100 is generally measured from a top surface 210 of the housing 112 to the top surface 212 of the stopper 110, as illustrated by arrow H in FIG. 2. Accordingly, the height is dependent on the length of the shaft 206 relative to the top surface 210 of the housing 112.

The housing 112 further defines one or more cavities 310 for holding the biasing devices 306. In one form, the cavities 310 may extend along an axis that is perpendicular to a longitudinal axis of the shaft 206. In the figures, the housing 112 is illustrated as a one-piece housing, but a multi-piece housing is also within the scope of the present disclosure.

Figure 4:
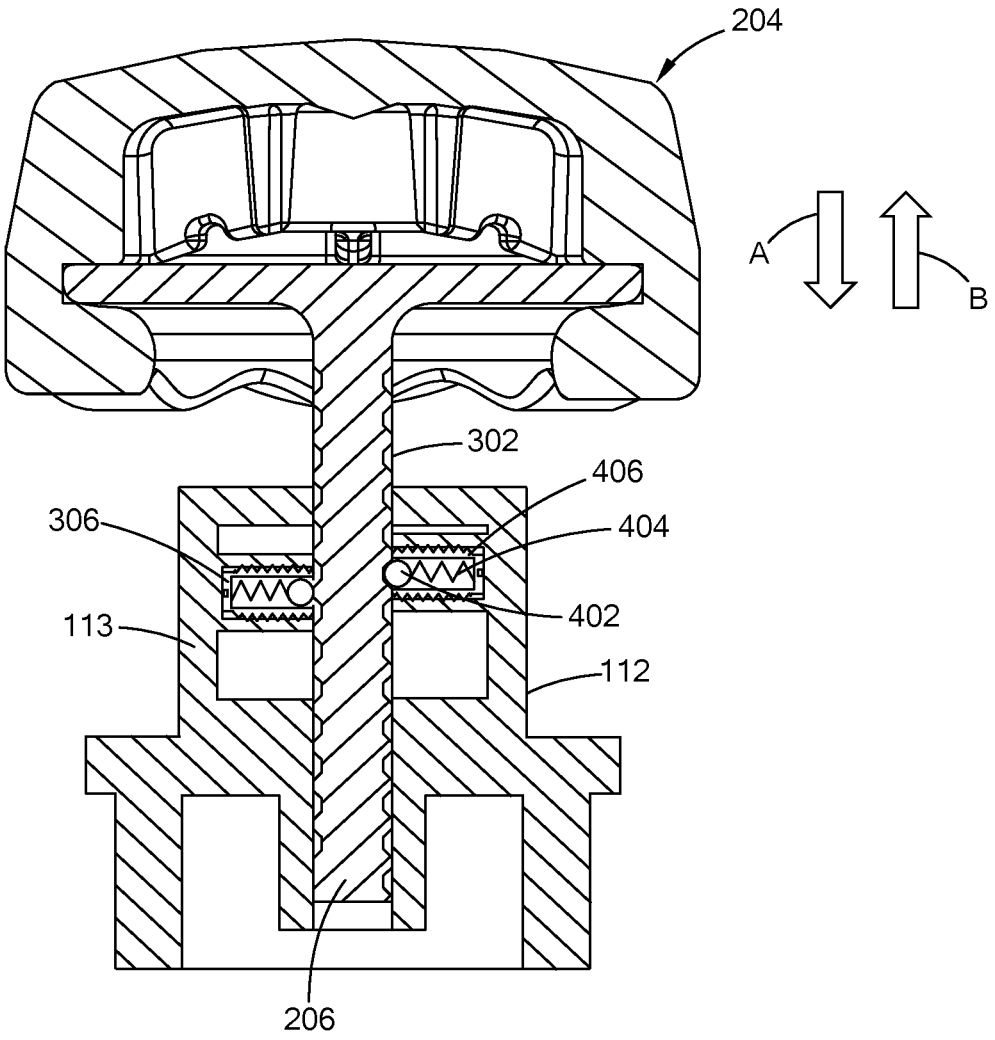
FIG. 4 is a cross-sectional view of the bump stop assembly of FIG. 1.

The biasing devices 306 control the movement of the stopper 110 to set the height of the stop assembly 100. Specifically, the biasing devices 306 engage with one or more recesses 302 of the shaft 206 to lock the height of the stopper 110, and disengage with the one or more recesses 302 to unlock the stopper 110 and allow the stopper 110 to move along the passage 304 of the housing 112. In one form, the biasing devices 306 are arranged on opposite sides of the housing 112 and are offset from each other to provide ratchet movement of the stopper 110. In one form, the biasing devices 306 are spring plungers, such as ball spring plungers that include a ball 402, a spring 404, and a casing 406 for housing the ball 402 and spring 404 (FIG. 4). The housing 112 includes at least two internal cavities and each biasing device 306 is disposed within one of the internal cavities between an outer wall 113 of the housing and the shaft 206. Also, each of the casings 406 is disposed within one of the internal cavities between the outer wall 113 of the housing 112 and the shaft 206. Generally, the spring 404 applies a force against the ball 402, such that a portion of the ball extends outside of the casing 406. When a counter force that is greater than the force applied by the spring 404 is placed on the ball 402, the ball 402 retracts into the casing 406. While the biasing devices 306 illustrated are ball-nose spring plungers, other suitable devices may be used for engaging and disengaging with the stopper 110. In addition, while two biasing devices 306 are shown for controlling the movement of the stopper 110, one or more biasing devices 306 may be used, and are within the scope of the present disclosure.

Referring to FIG. 4, the shaft 206 of the stopper 110 extends in the housing 112 with two biasing devices 306 arranged on opposite sides of the shaft 206 to interface with the recesses 302. The biasing devices 306 are operable to engage and disengage with at least one recess 302 based on a force, or in other words, a load exerted on the stopper 110. For example, when a compression load, represented by arrow A in the figure, is placed on stopper 110 to push the head 204 toward the housing 112, the shaft 206 exerts a force (e.g., first force) onto the biasing device 306. When the first force is greater than the force exerted by the springs 404 of the biasing devices 306 (e.g., a second force), the balls 402 of the biasing devices 306 moves to disengage with the recesses 302 and thus, the stopper 110 moves toward the housing 112 decreasing the height of the stop assembly 100. In one form, when the biasing devices 306 are disengaged from the recesses 302, the biasing devices 306 are in contact with a surface of the shaft 206 but release the recess 302 to allow movement of the shaft 206.

Similarly, if the stopper 110 receives an extension force, represented by arrow B in the figure, the biasing devices 306 disengage with the recesses 302 once the first force from the shaft is greater than the second force of the biasing device 306, and thus, the stopper 110 moves away from the housing 112 increasing the height of the stop assembly 100. The degree of movement of the stopper 110 between each disengagement-engagement of biasing devices is based on the spacing between the recesses 302, which can be set to any suitable value (e.g. 1 mm, 2 mm, etc). When the first force is less than the second force, the biasing devices 306 remain engaged with the recesses 302 to prevent the stopper 110 from moving and set the height of the assembly 100.

Figure 5:
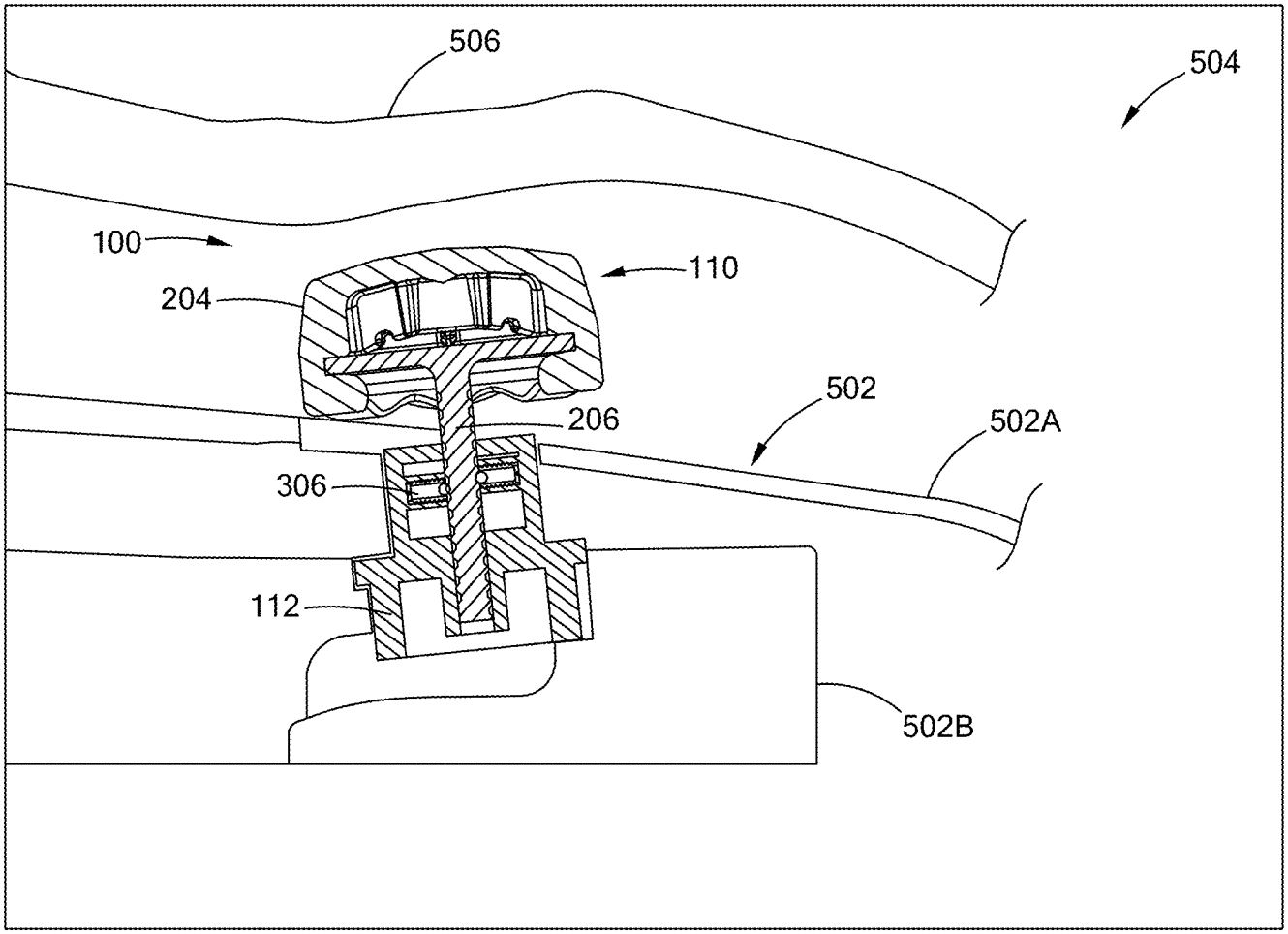
FIG. 5 is a partial cross-sectional view of the bump stop assembly in the vehicle in an extended position according to the teachings of the present disclosure.
Figure 6:
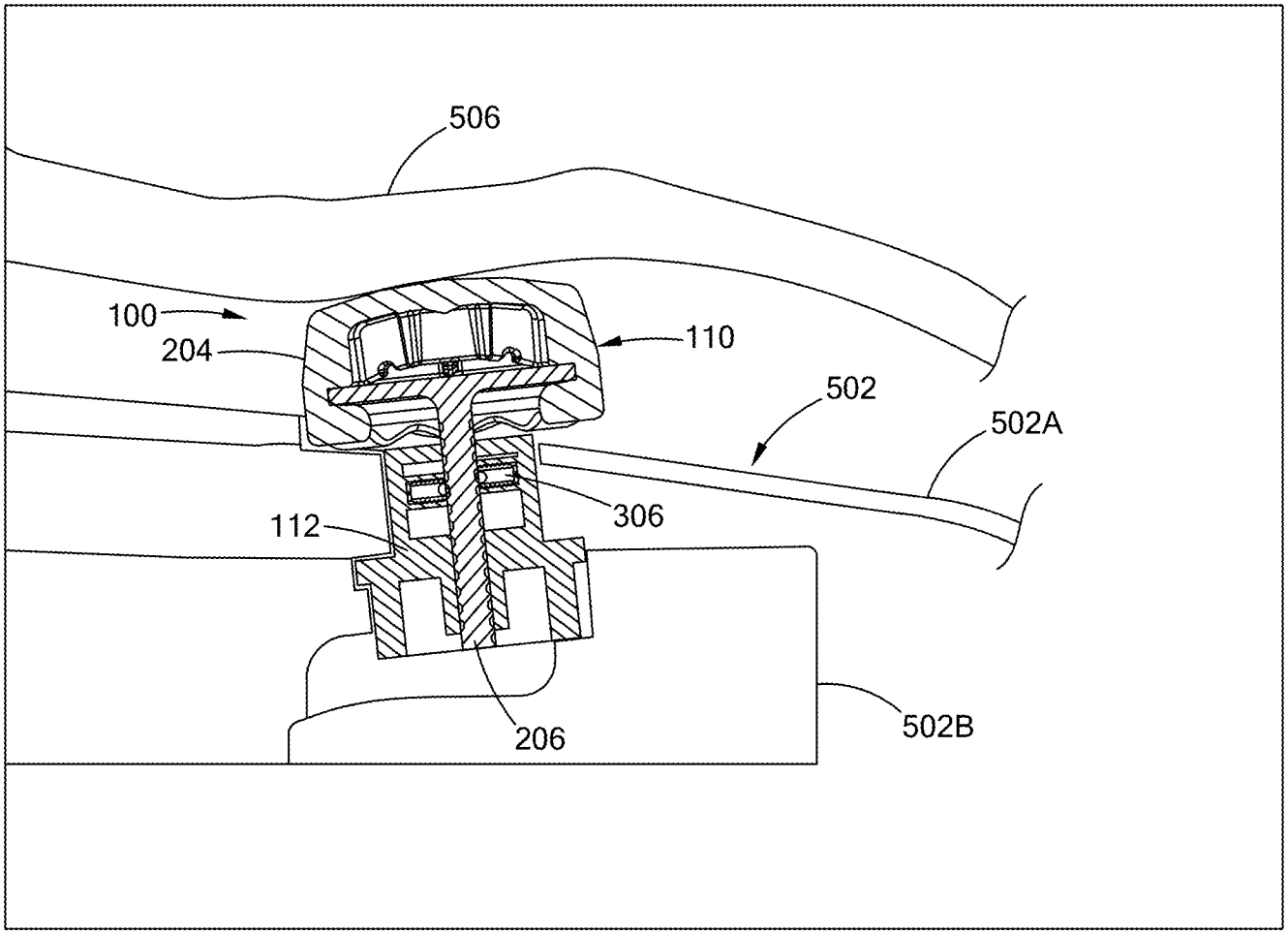
FIG. 6 is a partial cross-sectional view of the bump stop assembly in the vehicle in a compressed state according to the teachings of the present disclosure.

Referring to FIGS. 5 and 6, an example operation of the stop assembly 100 of the present disclosure is described. In FIG. 5, the stop assembly 100 is positioned in a front-end module 502 of a vehicle 504 such that a top surface of the housing 112 is slightly above a surface of the front-end module 502. In this example, the front-end module 502 includes an ornamental shield 502A and a support bar 502B. To set the stop assembly 100 to an appropriate height for supporting a hood 506 and aligning the hood 506 with the fender (not shown), in one form, the stop assembly 100 is first set to an extended state in which the height of the stop assembly 100 would position the hood 506 above the front end module 502 and the fender. The hood 506 is then lowered toward the front-end module 502, and the weight of the hood 506 (e.g., a first load) pushes on the stopper 110 causing the biasing devices 306 to disengage from and then engage with the recesses 302 and move the stopper 110 downward toward the front-end module 502 in a ratchet like manner (i.e., move a preset distance defined by the spacing of the recesses with each disengagement and engagement).

Once the hood 506 closes (e.g., latches to a lock), the load on the biasing devices 306 decreases (e.g., a second load), and the biasing devices 306 engage with recesses 302 along the shaft 206 to lock the height of the stop assembly 100. The stop assembly 100 is now in a compressed state at which the height of the stop assembly 100 is the appropriate height for supporting the hood 506 (FIG. 6). In one form, with the stop assembly 100 at the appropriate height, the hood 506 should be flush and aligned with the fender, and the stop assembly 100 applies sufficient counter load on the hood 506 to have the hood 506 pop up when the hood 506 is unlocked.

In one form, the height of the stop assembly 100 at the compressed, is utilized to pre-set the height of other stop assemblies before they are installed in the vehicle. If the height of the stop assembly 100 is lower than the appropriate height for supporting the hood, an extension force can be placed on the head 204 of the assembly 100 by, for example, an operator to increase the height of the assembly 100.

By having the weight of the moveable component lower the stop assembly 100 to the appropriate height, the stop assembly 100 of the present disclosure accurately sets the height of the assembly without relying on the operator's experience. In addition, various features of the stop assembly 100 can be customized for the moveable component and the component in which the assembly 110 is to be installed in (e.g., front end module, door assembly, etc). For example, the amount of force exerted by the biasing device is based on the load placed by the moveable component such that a lighter weight component may require a biasing device with less biasing force than that of a heavier weight component.

The teachings of the stop assembly of the present disclosure may also be applicable to other applications and should not be limited to vehicles. For example, the stop assembly may as be used in machines having moveable components (i.e., doors) that are to be aligned with a body (e.g., housing, frame, enclosure) of the machine.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A bump stop assembly for a vehicle, the assembly comprising:

a housing having at least two internal cavities and an outer wall;

a stopper including a head and a shaft extending from the head, wherein the shaft extends through the housing and defines a plurality of recesses distributed along the shaft; and the at least two internal cavities being blind with a closed end adjacent to the outer wall and an open end adjacent to the shaft, the at least two internal cavities further include upper and lower walls extending from the outer wall towards the shaft; and at least two biasing devices disposed in the housing on opposite of the shaft, each of the at least two biasing devices being disposed within one of the at least two internal cavities such that the upper and lower walls surround a single biasing device of the two biasing devices, wherein the at least two biasing devices are offset from each other along the length of the shaft and each of the at least two biasing devices is operable to decompress and engage and compress and disengage with a recess from the plurality of recesses based on a load applied to the stopper to provide ratchet movement of the stopper and to lock and unlock a position of the stopper relative to the housing, and wherein only one of the two biasing devices engages a recess at a time.

2. The bump stop assembly of claim 1, wherein the plurality of recesses are positioned along opposite sides of the shaft.

3. The bump stop assembly of claim 1, wherein the at least two biasing devices are ball-nose spring plungers.

4. The bump stop assembly of claim 1, wherein the housing defines at least two cavities for housing the at least two biasing devices.

5. The bump stop assembly of claim 1, wherein the at least two biasing devices are arranged in the housing such that one of the biasing devices interfaces with the recesses on one side of the shaft and another one of the biasing devices interfaces with the recesses on the other side of the shaft.

6. The vehicular stop assembly of claim 1, wherein the head has a resilient elastically deformable member, wherein the head is positioned above the housing, and the shaft extends from the head.

7. The bump stop assembly according to claim 1, wherein the housing comprises at least two casings, each casing disposed within one of the internal cavities, wherein each of the two ball-nose spring plungers comprise a ball and a spring housed within one of the two casings.

* * * * *